US008655244B2

(12) United States Patent
Hasegawa et al.

(10) Patent No.: US 8,655,244 B2
(45) Date of Patent: Feb. 18, 2014

(54) FIXING DEVICE AND IMAGE FORMING APPARATUS INCORPORATING SAME

(75) Inventors: Kenichi Hasegawa, Atsugi (JP); Masaaki Yoshikawa, Tokyo (JP); Akira Shinshi, Machida (JP); Kenji Ishii, Kawasaki (JP); Hiroshi Yoshinaga, Ichikawa (JP); Yoshiki Yamaguchi, Sagamihara (JP); Naoki Iwaya, Chofu (JP); Tetsuo Tokuda, Kawasaki (JP); Yutaka Ikebuchi, Chigasaki (JP); Toshihiko Shimokawa, Zama (JP); Shuntaroh Tamaki, Kawasaki (JP); Takamasa Hase, Kawasaki (JP); Ippei Fujimoto, Ebina (JP); Takahiro Imada, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 513 days.

(21) Appl. No.: 12/893,361

(22) Filed: Sep. 29, 2010

(65) Prior Publication Data

US 2011/0085832 A1 Apr. 14, 2011

(30) Foreign Application Priority Data

Oct. 9, 2009 (JP) ..... 2009-235174

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS

| | | | | |
|---|---|---|---|---|
| 6,864,461 | B2 * | 3/2005 | Okabayashi et al. | 399/329 |
| 7,027,763 | B2 * | 4/2006 | Kato et al. | 399/329 |
| 7,702,271 | B2 | 4/2010 | Yamada et al. | |
| 2006/0210288 | A1 * | 9/2006 | Hayashi et al. | |

(Continued)

FOREIGN PATENT DOCUMENTS

| | | |
|---|---|---|
| JP | 2004-061718 | 2/2004 |
| JP | 2004-309975 | 11/2004 |

(Continued)

OTHER PUBLICATIONS

U.S. Appl. No. 12/841,593, filed Jul. 22, 2010, Yoshikawa, et al.

(Continued)

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

A fixing device includes a stationary at least partially tubular thermal member, a flexible fuser belt, a fuser pad, and a rotatable pressure member. The thermal member has a tubular portion thereof extending in an axial direction and defining a closed axial cross-section. A circumference of the thermal member is subjected to heating. The fuser belt is looped for rotation around the thermal member. An inner circumference of the fuser belt at least partially faces the thermal member. The fuser pad is held stationary inside the loop of the fuser belt. The pressure member extends opposite the thermal member in the axial direction with the fuser belt interposed between the fuser pad and the pressure member. The fuser pad is pressed against the pressure member through the fuser belt to form a fixing nip. The thermal member is spaced apart from the fuser pad.

13 Claims, 7 Drawing Sheets

(56) References Cited

U.S. PATENT DOCUMENTS

| | | | | |
|---|---|---|---|---|
| 2007/0292175 | A1 | 12/2007 | Shinshi | |
| 2008/0112739 | A1 * | 5/2008 | Shinshi | 399/329 |
| 2008/0175633 | A1 | 7/2008 | Shinshi | |
| 2008/0219730 | A1 | 9/2008 | Shinshi | |
| 2008/0298862 | A1 | 12/2008 | Shinshi | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2009/0311016 | A1 | 12/2009 | Shinshi | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |

FOREIGN PATENT DOCUMENTS

| | | | |
|---|---|---|---|
| JP | 2006113179 A | * | 4/2006 |
| JP | 2008-146010 | | 6/2008 |
| JP | 2008-158482 | | 7/2008 |
| JP | 2008-257946 | | 10/2008 |
| JP | 2008-275753 | | 11/2008 |
| JP | 2009-3410 | | 1/2009 |
| JP | 2010-96782 | | 4/2010 |

OTHER PUBLICATIONS

U.S. Appl. No. 12/828,612, filed Jul. 1, 2010, Furuya, et al.

U.S. Appl. No. 12/823,770, filed Jun. 25, 2010, Hasegawa.

Office Action issued Oct. 25, 2013, in Japanese Patent Application No. 2009-235174.

Office Action issued Oct. 25, 2013, in Japanese Application No. 2009-235174.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2009-235174, filed on Oct. 9, 2009, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical, looped belts or rollers, one being heated for fusing toner ("fuser member") and the other being pressed against the heated one ("pressure member"), which together form a heated area of contact called a fixing nip through which a recording medium is passed to fix a toner image under heat and pressure.

One conventional type of fuser assembly employed in the fixing device is an endless belt looped for rotation around a generally cylindrical, stationary heat pipe typically formed of a thin wall of thermally conductive metal. The heat pipe has a heater inside or outside to conduct or carry heat over its circumference, from which heat is radially transferred to the length of the fuser belt rotating around the heat pipe. Using a thin-walled conductive heat pipe allows for heating the fuser belt swiftly and uniformly, resulting in shorter periods of warm-up time and first-print time required to complete an initial print job upon startup, and high immunity against printing failures caused by insufficient heating of the fixing nip in high-speed application.

Currently, two different configurations of heat pipes are available for use in electrophotographic fixing devices. One is a generally cylindrical, open-sided pipe formed by bending a sheet of thermally conductive material into a rolled configuration with a substantially C-shaped cross-section defining an elongated opening or slit on one side thereof. The other is a completely closed cylindrical pipe formed, for example, by bending a sheet of thermally conductive material into a rolled configuration, followed by bonding or welding together two opposed longitudinal edges of the rolled sheet to obtain a cylinder with a completely closed cross-section.

An open-sided heat pipe is used in combination with a separate fuser pad held stationary in its side opening outside the pipe interior and inside the loop of a fuser belt entrained around the heat pipe, with adequate spacing left between adjacent surfaces of the heat pipe and the fuser pad. When assembled into a fixing device, the open-sided heat pipe has its open side facing a pressure member extending parallel to the length of the pipe, so that the fuser pad is pressed against the pressure member through the thickness of the fuser belt to form a fixing nip.

On the other hand, a completely closed heat pipe is equipped with a reinforcing member held stationary against the inner circumference of the pipe for reinforcement purposes. When assembled, the completely closed heat pipe has its outer circumference facing a pressure member extending parallel to the length of the pipe, with the reinforcing member supporting those portions of the pipe circumference pressed against the pressure member to form a fixing nip.

Of the two types of heat pipe described above, the open-sided design is advantageous in terms of protection against deformation under nip pressure. That is, provision of the separate fuser pad enables the open-sided heat pipe to operate substantially in isolation from the pressure member, which can thus maintain its generally cylindrical configuration without bending or bowing away from the fixing nip under nip pressure. Such stability against deformation of the heat pipe in turn protects the fuser belt against damage and failure and results in proper operation of the fixing device, even where the heat pipe is extremely thin-walled to obtain high thermal efficiency in heating the fuser belt.

Although advantaged over its counterpart in terms of mechanical stability, the open-sided heat pipe has a drawback in that it can allow entry of foreign matter into the hollow interior through the side opening, in particular a lubricating agent provided to reduce friction between the adjacent surfaces of the heat pipe and the fuser belt. Leaking lubricant from outside to inside the heat pipe not only results in loss of lubrication, which causes high friction at the interface to aggravate wear and tear of the contacting surfaces, but also results in malfunctioning of or damage to the pipe heater where lubricant adheres to the heater surface and evaporates in the pipe interior.

By contrast, the completely closed cylindrical heat pipe is exempt from entry of foreign matter and leakage of lubricant into the pipe interior, since there is no access to the inside of the pipe from the outside along the circumference of the closed heat pipe.

However, the completely closed heat pipe tends to develop deformation as it is subjected to pressure contact with the pressure member during operation, despite the provision of a reinforcing member supporting the pipe circumference. This tendency toward deformation is pronounced where the heat pipe is formed of an extremely thin wall of material for obtaining maximum thermal efficiency, where the pressure member applies a higher nip pressure to obtain a longer fixing nip and more efficient fixing performance, and most particularly, where the heat pipe is subjected to varying nip pressure or repeatedly strikes the pressure member as the pressure member moves toward and away from the heat pipe to adjust length and strength (pressure) of the fixing nip.

If not corrected, deformation of the heat pipe results in various defects due to interference or mis-coordination between the fuser belt and the heat pipe, such as the belt getting damaged or making noise by locally and excessively rubbing against the heat pipe. Such defects can be unacceptable where the fixing device incorporates the capability to adjust the length and pressure of the fixing nip by moving the pressure member relative to the heat pipe.

Thus, the two conventional types of heat pipe each has advantages and drawbacks compared to the other in terms of mechanical stability of the cylindrical configuration and immunity against entry of foreign matter into the pipe interior. As long as this trade-off remains unsolved, neither is satisfactory for providing a reliable high-speed fixing device that can operate with extremely short warm-up time and first-print time, while highly immune to failures caused by insufficient heating of the fuser belt in high speed applications.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a stationary, at least partially tubular thermal member, a flexible fuser belt, a fuser pad, and a rotatable pressure member. The thermal member has a tubular portion thereof extending in an axial direction and defining a closed axial cross-section. A circumference of the thermal member is subjected to heating. The fuser belt is looped for rotation around the thermal member. An inner circumference of the fuser belt at least partially faces the thermal member to transfer heat from the heated circumference of the thermal member. The fuser pad is held stationary inside the loop of the fuser belt. The pressure member extends opposite the thermal member in the axial direction with the fuser belt interposed between the fuser pad and the pressure member. The fuser pad is pressed against the pressure member through the fuser belt to form a fixing nip through which a recording medium is passed to fix a toner image thereupon under heat and pressure. The thermal member is spaced apart from the fuser pad, so as to isolate the thermal member from pressure transmitted through the fuser pad from the pressure member.

Other exemplary aspects of the present invention are put forward in view of the above-described circumstances, and provide a novel image forming apparatus.

In one exemplary embodiment, the image forming apparatus includes an electrophotographic imaging unit and the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
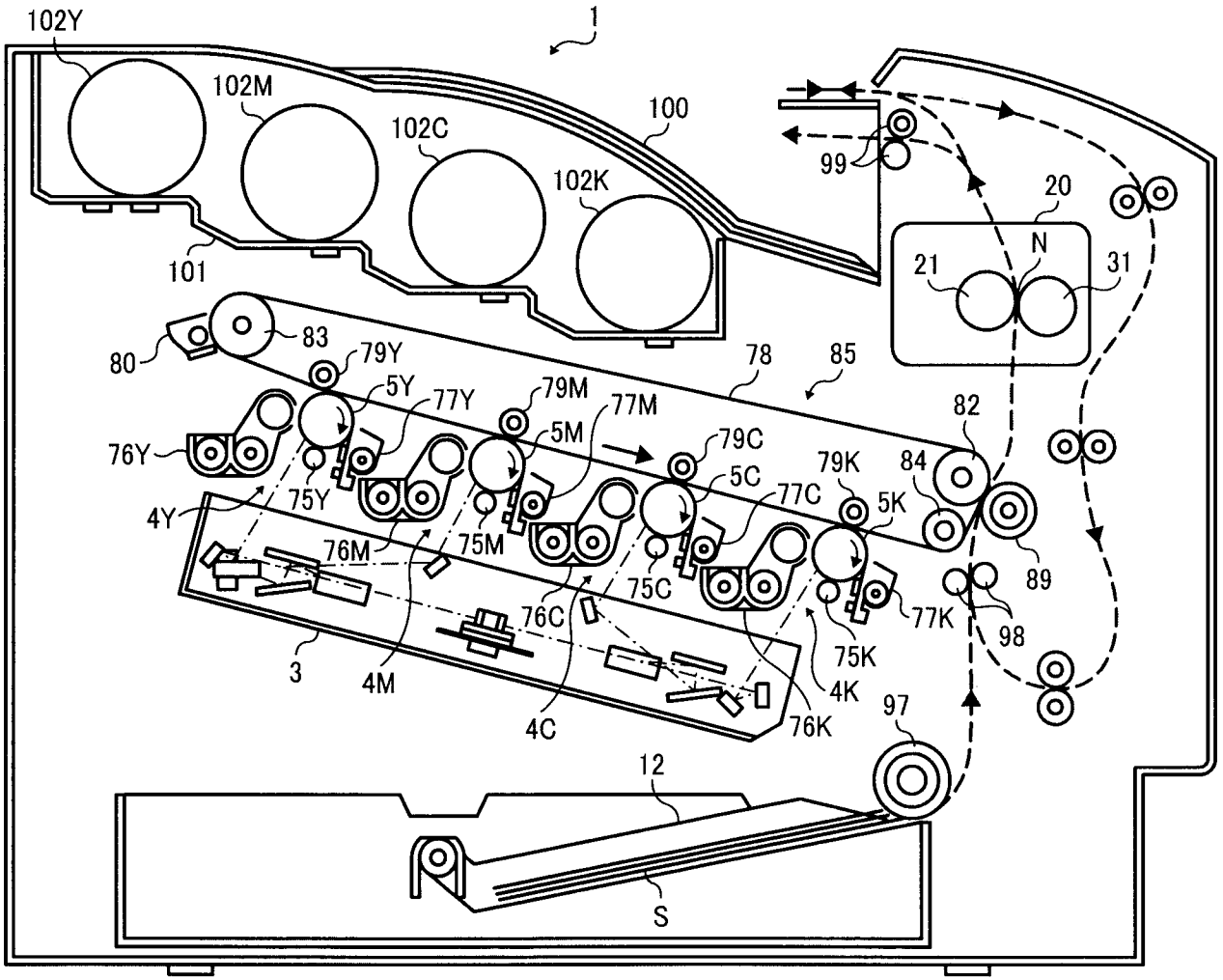
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 applies a bias voltage of a polarity opposite that of toner to the intermediate transfer belt 78. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

In the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
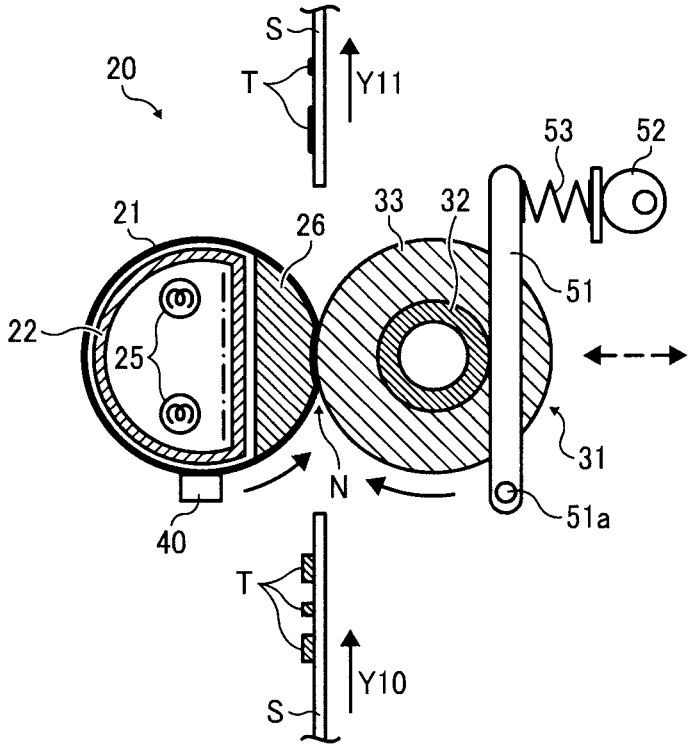
FIG. 2 is an end-on, axial cutaway view schematically illustrating a first embodiment of the fixing device according to this patent specification.
Figure 3:
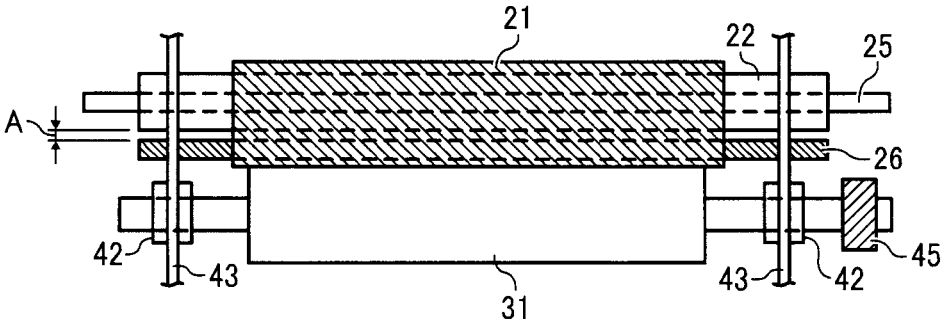
FIG. 3 is a transverse view schematically illustrating the fixing device of FIG. 2.

FIGS. 2 and 3 are end-on, axial cutaway and transverse views, respectively, schematically illustrating the fixing device 20 incorporated in the image forming apparatus 1 according to this patent specification.

As shown in FIGS. 2 and 3, the fixing device 20 includes a rotatable fuser belt 21 looped into a generally cylindrical configuration for rotation, and a rotatable, generally cylindrical pressure roller 31 held in pressure contact with an outer surface of the fuser belt 21. The cylindrical loop of fuser belt 21 and the pressure roller 31 are disposed parallel to each other along an axial, longitudinal direction between a pair of sidewalls 43 of the fixing device 20.

Inside the loop of the fuser belt 21 are a stationary heat pipe 22 and a stationary fuser pad 26, each extending in the longitudinal direction with two longitudinal ends fixed to the sidewalls 43. The fuser pad 28 is pressed against the pressure roller 31 through the fuser belt 21 to define a fixing nip N therebetween while establishing sliding contact with an inner surface of the rotating belt 21. The heat pipe 22 faces the inner surface of the looped belt 21 except where the fuser pad 26 forms the fixing nip N.

Disposed within the heat pipe 22 is a stationary heating assembly 25, formed of one or more radiant heaters having two longitudinal ends fixed to the sidewalls 43, which irradiates the inner side of the pipe 22 for heating the fuser belt 21. A thermometer 40 is disposed adjacent to the surface of the fuser belt 21 to detect the temperature of the belt surface for controlling operation of the heating assembly 25.

The pressure roller 31 has two ends rotatably held on the sidewalls 43 via a pair of bearings 42, one of which is connected to a drive motor, not shown, via a set of one or more gears 45 outside the sidewalls 43 for imparting a rotational force to the roller 31. The pressure roller 31 is pressed against the fuser belt 21 by a biasing mechanism consisting of a pressure lever 51, a motor-driven eccentric cam 52, and a spring 53, connected to the roller bearing 32 to adjust position of the roller 31 with respect to the fuser assembly to adjust the length or width of the fixing nip N along the sheet conveyance path of the image forming apparatus 1.

During operation, the fixing device 20 activates the roller drive motor and the heaters 25 as the image forming apparatus 1 is powered up. Upon activation, the heaters 25 start heating the heat pipe 22 by radiation, which eventually heats the fuser belt 21 to a processing temperature by conduction through the wall of the heat pipe 22. At the same time, the motor-driven pressure roller 31 starts rotation clockwise in FIG. 2 in frictional contact with the fuser belt 21, which in turn rotates around the heat pipe 22 counterclockwise in FIG. 2.

Then, a recording sheet S with an unfixed, powder toner image T enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10 perpendicular to the axial direction, substantially flat and erect along surfaces of guide plates, not shown, disposed along the sheet conveyance path.

At the fixing nip N, the fuser belt 21 heats the incoming sheet S to fuse and melt the toner particles T, while the pressure roller 31 presses the sheet S against the fuser pad 26 to cause the molten toner T to settle onto the sheet surface. As the toner image T is thus fixed in place through the fixing nip N, the recording sheet S is forwarded to exit the fixing device 20 in the direction of arrow Y11.

As used herein, the term "stationary" or "disposed stationary" refers to a condition of the fuser pad 26, the heat pipe 22, and other pieces of fixing equipment, in which those members remain still and do not rotate as the pressure member 31 and the fuser belt 21 rotate during operation. Hence, a stationary member may still be subjected to mechanical force or pressure resulting from its intended use (e.g., the fuser pad 26 pressed against the pressure member 31 by a biasing member), but only to an extent that does not cause substantial movement, rotation, or displacement of the stationary member.

The term "axial direction" herein refers to a direction in which the pair of generally cylindrical members 21 and 31 of the fixing device 20 extend, which is substantially perpendicular to the direction in which the recording medium S travels through the fixing nip N along the sheet conveyance path.

In the present embodiment of the fixing device 20, the fuser belt 21 comprises a thin, multi-layered, looped flexible belt approximately 1 mm or less in thickness and approximately 15 to 120 mm in diameter in its generally cylindrical looped shape (with an inner diameter of about 30 mm in the present embodiment), the overall length of which is formed of a substrate covered with an intermediate elastic layer and an outer release coating deposited thereon, one atop another.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of a release agent, such as tetra fluoro ethylene-perfluoro alkylvinyl ether copolymer or PFA, polytetrafluoroethylene (PTFE), polyimide (PI), polyetherimide (PEI), polyethersulfone (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

Inside the loop of the fuser belt 21 is the fuser pad 26 disposed stationary against the pressure roller 31. With additional reference to FIG. 4, which is an enlarged cross-sectional view schematically illustrating in detail the fuser pad 26 and surrounding members, the fuser pad 26 is shown formed of an elastic portion 26*a* and a stiff portion 26*b* combined together into a composite structure.

Specifically, the elastic portion 26*a* is formed of rubber and disposed where the fuser pad 26 faces the pressure member 31 through the fuser belt 21 to form the fixing nip N, with its exposed side defining a pliant contact surface to establish sliding contact with the pressure roller 31 through the fuser belt 21.

The elastic portion 26*a* closely conforms to minute irregularities in the surface of a toner image processed through the fixing nip N for obtaining good fusing performance, with its contact surface available in various configurations according to particular applications of the fixing device 20.

For example, the contact surface of the elastic portion 26*a* may be slightly concave with a curvature similar to that of the circumference of the pressure roller 31. The concave contact surface readily conforms to the surface of the pressure roller 31 along which a recording sheet S passes through the fixing nip N, which ensures reliable conveyance of the sheet S without the sheet S adhering to and wrapping around the fuser belt 21 upon exiting the fixing nip N.

Alternatively, instead of the concave configuration, the contact surface of the elastic portion 26*a* may be substantially flat. The flat contact surface causes a recording sheet S to remain straight and uniformly contact the fuser belt 21 within the fixing nip N, resulting in efficient fusing performance, while allowing for good stripping of the recording sheet S from the fuser belt 21 which exhibits a curvature larger at the exit of the fixing nip N than within the fixing nip N.

Around the elastic portion 26*a* is the stiff portion 26*b* formed of sufficiently stiff material, such as rigid metal or ceramic, to withstand pressure from the pressure roller 31 without deformation. A sheet impregnated with lubricant such as fluorine grease may be disposed around the stiff portion 26*b* to reduce friction between the fuser pad 26 and the fuser belt 21.

Referring back to FIG. 2, also inside the loop of the fuser belt 21 is the heat pipe 22 disposed stationary away from the pressure roller 31 and accommodating the heating assembly 25 stationary within its hollow interior.

As shown in FIG. 2, the heat pipe 22 comprises an at least partially tubular, thermal member with a tubular portion thereof extending in the axial direction and defining a closed axial cross-section, which resembles the letter "D" in the present embodiment. The heat pipe 22 is formed of a conductive material, such as stainless steel, aluminum, iron, or other suitable metal, with a thickness not exceeding 0.2 mm, preferably, not exceeding 0.1 mm. Forming the heat pipe 22 with a wall thickness not exceeding 0.2 mm is desirable for promptly heating the pipe circumference to a processing temperature during operation.

In the present embodiment, the heat pipe 22 is formed of a stainless steel approximately 0.1 mm thick, with its tubular body internally coated with light reflective material or subjected to a bright annealing or mirror polish where the inner circumference of the fuser belt 21 does not face the heat pipe 22 outside (i.e., in the area indicated by broken lines in FIG. 2). Also, the tubular body of the heat pipe 22 may be internally coated with heat-resistant, black absorptive material where the inner circumference of the fuser belt 21 faces the heat pipe 22 outside (i.e., in the area other than that indicated by broken lines in FIG. 2).

Reflective treatment enables the coated area of the tubular body to repel or reflect radiation from the heaters 25, and direct it toward the side where the inner circumference of the fuser belt 21 faces the heat pipe 22 outside, leading to enhanced heating efficiency in the fixing device 20. On the other hand, absorptive coating enables the coated area of the tubular body to effectively absorb radiation from the heaters 25 where the inner circumference of the fuser belt 21 faces the heat pipe 22 outside, leading to enhanced heating efficiency in the fixing device 20.

A more detailed description will be given later of specific features of the heat pipe 22 according to this patent specification.

The heating assembly 25 comprises one or more radiant heaters, such as halogen heaters or carbon heaters. To warm up the fixing device 20, the radiation heating assembly 25 heats the metal roller 22 directly through radiation, and the fuser belt 21 indirectly through conduction from the metal roller 22 being heated. That is, the heaters 25 irradiate the inner circumference of the heat pipe 22, which then conducts heat to those portions of the fuser belt 21 in the proximity of the pipe circumference (i.e., except where the belt circumference faces the fuser pad 26). As the fuser belt 21 rotates, this results in uniformly heating the entire length of the rotating belt 21 sufficiently for fusing toner at the fusing nip N.

Such heating is controlled by regulating a power supply to the respective heaters 25 according to readings of the thermometer 40 sensing temperatures of the outer circumference of the fuser belt 21 to maintain the belt surface at a desired processing temperature.

Thus, the fuser belt 21 has its length heated substantially continuously and uniformly by conduction from the outer circumference of the metal roller 22 being internally heated by irradiation with the heaters 25. Compared to directly and locally heating portions of a fuser member, such indirect continuous heating can warm up the entire length of the fuser belt 21 swiftly and efficiently with a relatively simple configuration, which allows the fixing device 20 to operate at higher processing speeds without causing image defects due to premature entry of recording sheets into the fixing nip N. This leads to a reduction in warm-up time and first-print time required for completing an initial print job upon startup, while maintaining a compact size of the image forming apparatus 1 incorporating the fixing device 20.

In the present embodiment, the heating assembly 20 includes a pair of elongated heaters extending in the axial direction, one dedicated to heat a longitudinal center of the heat pipe 22, and the other dedicated to heat two longitudinal ends of the heat pipe 22. For example, the heating assembly 25 may have a central heater facing a center portion extending approximately 210 mm (equal to the length of the shorter edge of an A4-size copy sheet) along the axial direction, and a sub-central heater facing an end portion extending approximately 297 mm (equal to the length of the shorter edge of an A3-size copy sheet) along the axial direction except for the 210-mm center portion.

In this arrangement, the fixing device 20 can heat a desired area of the heat pipe 22 by selectively activating either or both of the paired heaters 25 depending on the size of recording sheet S in use. For example, when processing an A4-size copy sheet with its longer edge directed along the sheet conveyance path (i.e., with its shorter edges as the leading and trailing edges), the fixing device 20 activates only the central heater for heating the longitudinal center of the heat pipe 22. By contrast, when processing an A3-size copy sheet with its longer edge directed along the sheet conveyance path (i.e., with its shorter edges as the leading and trailing edges), or when processing an A4-size copy sheet with its shorter edge directed along the sheet conveyance path (i.e., with its longer edges as the leading and trailing edges), the fixing device 20 activates both the central and sub-central heaters for heating the entire length of the heat pipe 22.

Thus, selective activation of the pair of heaters 25 enables the fixing device 20 to heat a desired area of the heat pipe 22, so as not to excessively heat the longitudinal ends of the heat pipe 22 where the fixing device 20 processes recording sheets S of relatively small size in succession. The configuration of the heating assembly 25 is not limited to that depicted in the present embodiment, and the heating assembly 25 may be configured with any number and configuration of heaters depending on specific application of the fixing device 20.

Figure 4:
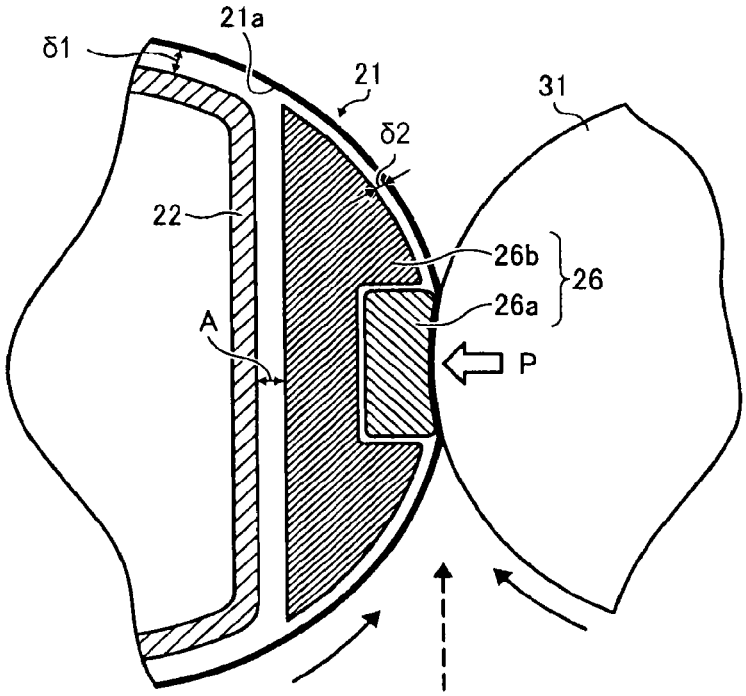
FIG. 4 is an enlarged, end-on, axial cutaway view illustrating the fixing device of FIG. 2.

With particular reference to FIG. 4, there is a gap or clearance δ1 equal to or smaller than 1 mm between the inner circumference of the fuser belt 21 and the outer circumference of the heat pipe 22. Also, a gap or clearance δ2 not exceeding 1 mm is defined between the inner circumference of the fuser belt 21 and the outer circumference of the fuser pad 26 except at the fixing nip N. Maintaining the gaps between the fuser belt 21 and its adjacent surfaces prevents the elastic belt surface from premature wear caused by excessive rubbing. Moreover, holding the gap δ1 within an adequate range ensures efficient heat transfer from the heat pipe 22 to the fuser belt 21, which prevents failures caused by insufficient heating at the fixing nip N.

Note that, as shown in FIG. 2, the heat pipe 22 and the fuser pad 26 together define a closed curved surface with a circumference thereof smaller than the inner circumference of the fuser belt 21. With the small gaps left between the fuser belt 21 and its adjacent surfaces, the fuser belt 21 may move along the closed curved surface during rotation around the heat pipe 22. This allows the fuser belt 21 to maintain its generally cylindrical configuration, thereby protecting the belt 21 against deterioration and breakage resulting from deformation.

In addition, the fuser belt 21 and the heat pipe 22 are provided with a lubricating agent, such as fluorine grease, deposited between their adjacent surfaces. The lubricant reduces friction at the interface to prevent wear and tear on the fuser belt 21 even when operated in continuous frictional contact with the heat pipe 22.

Referring back to FIGS. 2 and 3, there is shown the pressure roller 30 rotating in pressure contact with the outer circumference of the fuser belt 21 to form the fixing nip N.

The pressure roller 31 comprises a cylindrical rotatable body approximately 30 mm in diameter, formed of a hollow, cylindrical metal core 32 covered with an outer layer 33 of elastic material, such as foamed or solid silicone rubber, fluorine rubber, or the like, and optionally, with an additional coating of a release agent, such as PFA, PTFE, or the like, deposited on the elastic layer 33. Further, the pressure roller 31 may have a heating element, such as a halogen heater, within the interior of the hollow roller core 32.

Forming the roller outer layer 33 with sponge material is advantageous, since it prevents excessive nip pressure, which would otherwise cause the heat pipe 22 to substantially bend away from the pressure roller 31 at the fixing nip N. Another advantage is that it provides favorable thermal insulation at the fixing nip N to prevent heat transfer from the fuser belt 21 to the pressure roller 31, leading to enhanced heating efficiency in the fixing device 20.

Although the fuser belt 21 and the pressure roller 31 are of a substantially identical diameter in the embodiment depicted in FIGS. 2 and 3, instead, it is possible to provide the cylindrical fixing members 21 and 31 with different diameters, in particular, the fuser belt 21 with a relatively small diameter and the pressure roller 31 with a relatively large diameter. Forming the fuser belt 21 with a diameter smaller than that of the pressure roller 31 translates into a greater curvature of the fuser belt 21 than that of the pressure roller 31 at the fixing nip N, which effects good stripping of a recording sheet from the fuser belt 21 upon exiting the fixing nip N.

As mentioned, the pressure roller 31 is equipped with the biasing mechanism formed of the pressure lever 51, the eccentric cam 52, and the spring 53. The pressure lever 51 has one hinged end provided with a hinge 51*a* and another, free end loaded with the spring 53 connected to the eccentric cam 52 via a spacer, while supporting the rotational axis of the pressure roller 31 via the roller bearing 42 held on an elongated slot defined in the sidewall 43 displaceably with an appropriate allowance for movement. The eccentric cam 52 is driven for rotation by a motor, not shown, to cause the pressure lever 51 to swivel on the hinge 51*a*, which in turn displaces the pressure roller 31 either toward or away from the fuser belt 21.

Such biasing mechanism enables the fixing device 20 to move the pressure roller 31 into pressure contact with the fuser belt 21 to form a desired fixing nip by setting the eccentric cam 52 to an operating position (i.e., such as one depicted in FIG. 2) upon entering operation, and to retract the pressure roller 31 away from the fuser belt 21 to remove nip pressure by rotating the eccentric cam 52 by 180 degrees from the operating position when out of operation or under maintenance where normal operation is suspended for correcting faults such as paper getting jammed in the fixing nip N.

Having described the general configuration, the following describes in detail the first embodiment of the fixing device 20 with various structural and operational features according to this patent specification.

With continued reference to FIGS. 2, 3, and 4, the heat pipe 22 comprises an at least partially tubular, thermal member with a tubular portion thereof extending in the axial direction and defining a closed, substantially D-shaped axial cross-section, within which the heating assembly 25 is accommodated. The heat pipe 22 has its outer circumference partially (i.e., along the flat side of the D-shape) facing the fuser pad 26, and partially (i.e., along the curved side of the D-shape) facing the inner surface of the looped fuser belt 21.

As used herein, the term "being at least partially tubular" or "tubular portion" of the heat pipe 22 refers to any hollow, elongated structure with a closed axial cross-section, formed of thermally conductive material through metalworking or other suitable manufacturing processes. Such manufacturing methods include seamless tubing processing, wherein a single piece of material is formed into a tubular configuration through extrusion or drawing, as well as welded tubing processing, wherein edges of one or more formed pieces of material are connected together into a tubular configuration through welding, for example, bending a sheet of metal into a rolled configuration with a substantially C-shaped cross-section, followed by welding opposed edges of the rolled sheet together with an intermediate member therebetween.

Compared to an open-sided pipe that has a side opening extending partially or entirely along its longitudinal side, the closed tubular configuration of the heat pipe 22 is highly immune to entry of foreign matter into its hollow interior from outside, in particular, that of the lubricating agent disposed between the fuser pipe 22 and the fuser belt 21 for reducing friction at the interface. Leaking lubricant from outside to inside the heat pipe not only results in loss of lubrication, which causes high friction at the belt-pipe interface to aggravate wear and tear of the contacting surfaces, but also results in malfunctioning of or damage to the pipe heater where lubricant adheres to the heater and evaporates in the pipe interior. Hence, the use of the closed tubular heat pipe 22 is particularly effective where a lubricant with high penetration rates, such as fluorine grease, is used, which is the case for the present embodiment.

Figure 5:
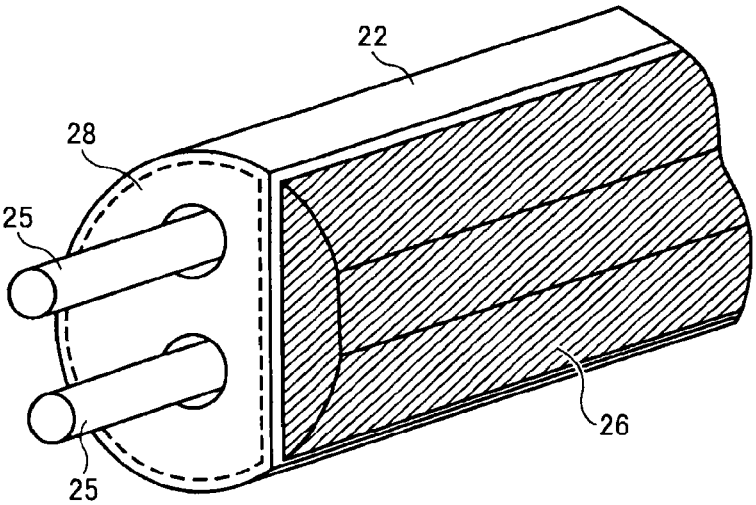
FIG. 5 is a perspective view schematically illustrating a heat pipe employed in the fixing device of FIG. 2.

For secure protection against entry of foreign matter, additional features may be provided which prevent lubricant from entering through open longitudinal ends of the heat pipe 22. For example, as shown in FIG. 3, the heat pipe 22 may have its two longitudinal edges each spaced apart from an adjacent edge of the fuser belt 21. Such spacing prevents lubricant from migrating from the belt surface into the pipe interior through the open ends of the heat pipe 22. Further, as shown in FIG. 5, which shows the heat pipe 22 and the fuser pad 26 in perspective view, the heat pipe 22 may have its longitudinal ends each provided with a cap 28 closing the end opening. Provision of the caps 28 reliably prevents lubricant from passing through the open ends of the heat pipe 22 into the pipe interior.

In addition to high immunity against entry of foreign matter, the closed tubular heat pipe 22 is advantaged over an open-sided heat pipe in that it is highly immune to deformation after manufacture. This is because the tubular configuration of the heat pipe 22, which may be obtained through extrusion, drawing, or bending followed by welding, is substantially insusceptible to "springback" or elastic recovery of the thin sheet of material after bending experienced by most open-sided heat pipes.

With specific reference to FIGS. 3 and 4, there is a gap or spacing A provided between the heat pipe 22 and the fuser pad 26, each disposed stationary inside the loop of the fuser belt 21 by being secured to the sidewalls 43 of the fixing device 20. The gap A extends approximately 1 mm or larger between the adjacent surfaces of the heat pipe 22 and the fuser pad 26 where no load is applied from the pressure roller 31 in the direction designated by an arrow P in FIG. 4.

Provision of the gap A prevents the metal pipe 22 from contacting or pressing against the fuser pad 26, where the fuser pad 26 bends away from the pressure roller 31 as it is subjected to higher pressures applied by the pressure roller 31, or to repeated strikes against the pressure roller 31 during adjustment of nip pressure. When deformed, the fuser pad 26 may have its longitudinal center displaced to a maximum of approximately 1 mm toward the heat pipe 22, with the longitudinal ends remaining in their original positions fixed to the respective sidewalls 43. The gap A is sized to accommodate the amount of deformation experienced by the fuser pad 26 under nip pressure, so that the heat pipe 22 does not come into contact with the fuser pad 26 during operation. Even where the heat pipe 22 contacts the fuser pad 26 whose amount of deformation exactly matches the extent of the gap A, such contact is established without significant pressure that would stress and deform the heat pipe 22.

As mentioned earlier, the heat pipe 22 is preferably configured as an extremely thin-walled pipe with a wall thickness not exceeding approximately 0.2 mm, which is thermally efficient and allows for shorter warm-up time than that possible with a thick-walled heat pipe.

An extremely thin-walled heat pipe is relatively low in strength, and therefore is vulnerable to bending or bowing when subjected to high mechanical force. If not corrected, deformation of the heat pipe results in damage and failure of the fuser belt, such as slipping off the heat pipe or inconsistent heating due to non-uniform contact between the fuser belt and the heat pipe. Spacing the heat pipe 22 away from the fuser pad 26 securely protects the heat pipe 22 from nip pressure transmitted through the fuser pad 26, thereby allowing for use of an extremely thin-walled heat pipe without causing deformation and concomitant failures of the fuser belt 21.

Thus, the gap or spacing A isolates the heat pipe 22 from nip pressure applied by the pressure roller 31, which ensures high immunity of the heat pipe 22 against deformation even where the heat pipe 22 is of an extremely thin wall of material, or where the pressure roller 31 presses against the fuser pad 26 at higher nip pressures, or where the pressure roller 31 repeatedly strikes against the fuser pad 26 as it is positioned with respect to the fuser belt 21 to adjust the length and pressure of the fixing nip N.

As used herein, the term "isolation from nip pressure" refers to conditions where the heat pipe 22 is kept away from substantial mechanical force exerted by pressing the pressure roller 31 against the fuser pad 26, and thereby maintains its original shape during operation of the fixing device 20. Such conditions include, but are not limited to, where the heat pipe 22 merely touches the fuser pad 26 or other surrounding structure whose amount of deformation exactly matches the extent of gap A, which, however, does not transmit high pressure from the pressure roller 31 therethrough to deform the heat pipe 22 upon contact.

In addition to isolating the heat pipe 22 from nip pressure, the gap A between the heat pipe 22 and the fuser pad 26 also serves to retain lubricant for future supply to the inner surface of the fuser belt 21.

In the present embodiment, the gap A is filled with lubricant such as fluorine grease, which is also applied to the interface between the heat pipe 22 and the fuser belt 21 and to the interface between the fuser pad 26 and the fuser belt 21. The lubricant is held in position by surface tension within the extremely narrow gap A, of which a certain amount flows gradually and continually toward the inner surface of the fuser belt 21 as the lubricant originally applied to the belt surface wears off with time. Such gradual, continual supply of lubricant effectively prevents premature loss of lubrication of the fuser belt 21 so that the fuser belt 21 can rotate without excessive friction for an extended period of time during operation of the fixing device 20.

Hence, the fixing device 20 according to this patent specification can operate with extremely short warm-up time and first-print time without failures caused by insufficient heating in high speed application, wherein the closed tubular configuration of the thermal pipe 22, with its tubular body facing the inner surface of the fuser belt 21 for heating and spaced away from the fuser pad 26 for isolation from nip pressure, provides protection against entry of lubricant and other foreign matter into the heat pipe, against premature loss of lubrication of the fuser belt, and against deformation of the heat pipe under nip pressure even where the heat pipe is of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

Figure 6:
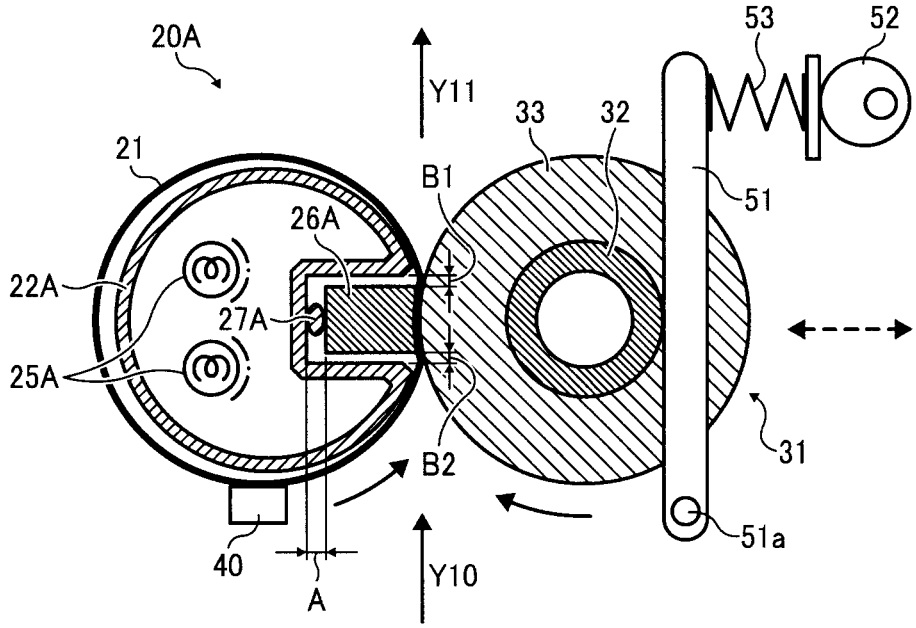
FIG. 6 is an end-on, axial cutaway view schematically illustrating a second embodiment of the fixing device according to this patent specification.

FIG. 6 is an end-on, axial cutaway view schematically illustrating a second embodiment 20A of the fixing device according to this patent specification, which differs from the first embodiment 20 primarily in that it employs a concave-sided heat pipe 22A and a relatively thick fuser pad 26A in place of the flat-sided heat pipe 22 and the relatively thin fuser pad 26, as well as a directional heating assembly 25A in place of the non-directional heating assembly 25.

As shown in FIG. 6, the overall configuration of the fixing device 20A is similar to that depicted primarily with reference to FIG. 2, including the fuser pad 26A pressed against the pressure roller 31 via the fuser belt 21 to form the fixing nip N, the heat pipe 22A equipped with the heaters 25A operated according to readings of the thermometer 40, and the biasing mechanism formed of the pressure lever 51, the motor-driven eccentric cam 52, and the spring 53 for adjusting pressure at the fixing nip N, wherein the closed tubular heat pipe 22A has its closed tubular body facing the inner surface of the fuser belt 21 for heating the belt 21 except where the belt surface faces the fuser pad 26A.

Specifically, unlike the first embodiment, the heat pipe 22A has an elongated slot extending along the pipe length to accommodate the fuser pad 26A on the side directed toward the pressure roller 31, which is defined by the pipe wall bent inward away from the fixing nip N in a first, load direction in which the pressure roller 31 exerts pressure against the fuser pad 26, then bent into a second, non-load direction substantially perpendicular to the first direction, and then again bent outward toward the fixing nip N in the first direction.

Also unlike the first embodiment, the fuser pad 26A comprises a relatively thick, square elongated body having a generally rectangular axial cross-section, with its length substantially equal to that of the heat pipe 22A, its depth (i.e., cross-sectional dimension along the non-load direction) substantially equal to or slightly greater than the length of the fixing nip N, and its thickness (i.e., cross-sectional dimension along the load direction) sufficiently long to obtain a high second moment of area for effectively resisting bending and deflection under load.

The fuser pad 26A is inserted into the side slot of the heat pipe 22A with appropriate spacing provided between adjacent surfaces. That is, between the heat pipe 22A and the fuser pad 26A there are provided a relatively large gap A where their adjacent surfaces extend parallel to each other along the non-load direction, and a pair of relatively narrow gaps B1 and B2 where their adjacent surfaces extend parallel to each other along the load direction.

Provision of the gaps A, B1, and B2 prevents the metal pipe 22A from contacting or pressing against the fuser pad 26A, where the fuser pad 26A bends away from the pressure roller 31 as it is subjected to higher pressures applied by the pressure roller 31. As is the case with the first embodiment, such spacing isolates the heat pipe 22A from nip pressure applied by the pressure roller 31, which ensures high immunity of the heat pipe 22A against deformation.

For effectively isolating the heat pipe 22A from nip pressure, the first gap A extending in the load direction is sufficiently large, so as to keep the heat pipe 22A out of pressure contact with the fuser pad 26A, which tends to bend away from the fixing nip N in the load direction during operation. By contrast, the second gaps B1 and B2 extending in the non-load direction are relatively small so as to properly position the fuser pad 26A while maintaining proper spacing in the non-load direction.

With continued reference to FIG. 6, the directional heating assembly 25A comprises one or more radiant heaters, such as halogen lamps, each enclosed in a glass envelope having an outer surface thereof partially coated with a heat-resistant, white reflective material (indicated by broken lines in FIG. 6). Each directional heater 25A is positioned inside the heat pipe 22A with the reflective-coated side directed away from the inner circumference of the pipe 22A. In this arrangement, the directional heater 25A can direct all of its radiation to those portions of the heat pipe 22A that face the fuser belt 21 outside, as the reflective coating reflects light emitted from the halogen lamp, resulting in high efficiency in heating the fuser belt 21 through the heat pipe 22A.

Use of the directional heater 25A is particularly desirable in the present embodiment where the concave-sided heat pipe 22A has its entire interior surface coated solely with heat-resistant, black absorptive material for promoting absorption of radiated heat, in contrast to the flat-sided heat pipe 22 internally coated partly with reflective material and partly with black absorptive material. This arrangement is reasonable considering the manufacturing difficulty and cost required to provide different types of coating to intended portions of the relatively complex interior surface of the concave-sided heat pipe 22A.

With further reference to FIG. 6, there is shown a lubricant retaining member 27A disposed outside the closed interior of the heat pipe 22A and out of sliding contact with the inner surface of the fuser belt 21A to retain lubricant for future supply to the inner surface of the fuser belt 21A. The lubricant retaining member 27A comprises a heat-resistant elastic sponge impregnated with lubricant, positioned within the extremely narrow gap A defined between the adjacent surfaces of the heat pipe 22A and the fuser pad 26A.

The lubricant retaining member 27A retains lubricant between the adjacent surfaces of the heat pipe 22A and the fuser pad 26A which is also retained by surface tension within the extremely narrow gap A, and releases a certain amount of lubricant gradually and continually toward the inner surface of the fuser belt 21 as the lubricant originally applied to the belt surface wears off with time. Such gradual, continual supply of lubricant effectively prevents premature loss of lubrication of the fuser belt 21 so that the fuser belt 21 can rotate without excessive friction for an extended period of time during operation of the fixing device 20A.

Although interposed between the adjacent surfaces of the heat pipe 22A and the fuser pad 26A, the lubricant retaining member 27A formed of elastic material does not transmit mechanical stress from the fuser pad 26A to the heat pipe 22A. Hence, provision of the lubricant retaining member 27A does not affect isolation of the heat pipe 22A from nip pressure, which secures high immunity of the heat pipe 22A against deformation even where the fuser pad 26A deforms under nip pressure.

Figure 7:
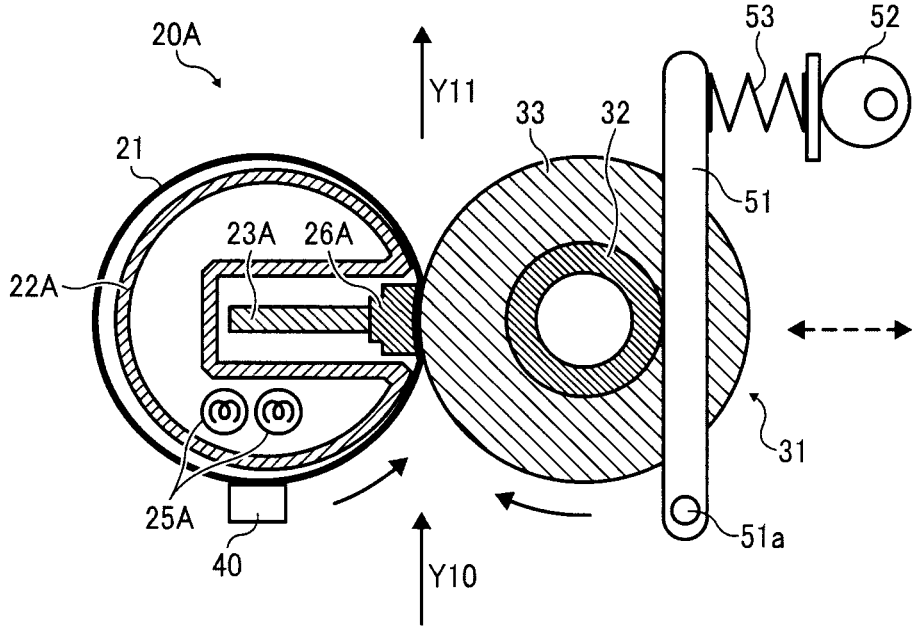
FIG. 7 is an end-on, axial cutaway view illustrating an arrangement of the second embodiment.

In the embodiment depicted in FIG. 6, the fixing device 20A employs the relatively thick fuser pad 26A to resist deformation under load. Instead, it is also possible to use a reinforcing member 23A to reinforce the fuser pad 26A in the load direction. FIG. 7 schematically illustrates such arrangement of the second embodiment.

As shown in FIG. 7, the reinforcing member 23A comprises a flat elongated beam having a length substantially equal to that of the fuser pad 26A. The reinforcing member 23A is disposed stationary inside of the loop of the fuser belt 21 and outside of the hollow heat pipe 22A, or more precisely, inserted in the side slot of the heat pipe 22A with its two longitudinal ends secured to the sidewalls of the fixing device 20A.

When viewed in cross-section, the reinforcing member 23A extends in the load direction, with one end held against the fuser pad 26 and the other end pointing away from the fuser pad 26. The reinforcing member 23A thus supports pressure applied from the pressure roller 31 via the fuser pad 26A and the fuser belt 21, thereby preventing the fuser pad 26A against deformation and displacement under nip pressure. For obtaining sufficient reinforcing performance, the reinforcing member 23A is formed of relatively rigid material, such as stainless steel, iron, or the like.

Note that the heat pipe 22A is spaced away from the reinforcing member 23A. Such spacing isolates the heat pipe 22A from nip pressure transmitted through the fuser pad 26A and the reinforcing member 23A from the pressure roller 31, which ensures high immunity of the heat pipe 22A against deformation.

Hence, the fixing device 20A according to this patent specification can operate with extremely short warm-up time and first-print time without failures caused by insufficient heating in high speed application, wherein the closed tubular configuration of the thermal pipe 22A, with its tubular body facing the inner surface of the fuser belt 21 for heating and spaced away from the fuser pad 26A or the reinforcing member 23A for isolation from nip pressure, provides protection against entry of lubricant and other foreign matter into the heat pipe, against premature loss of lubrication of the fuser belt, and against deformation of the heat pipe under nip pressure even where the heat pipe is of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

Figure 8:
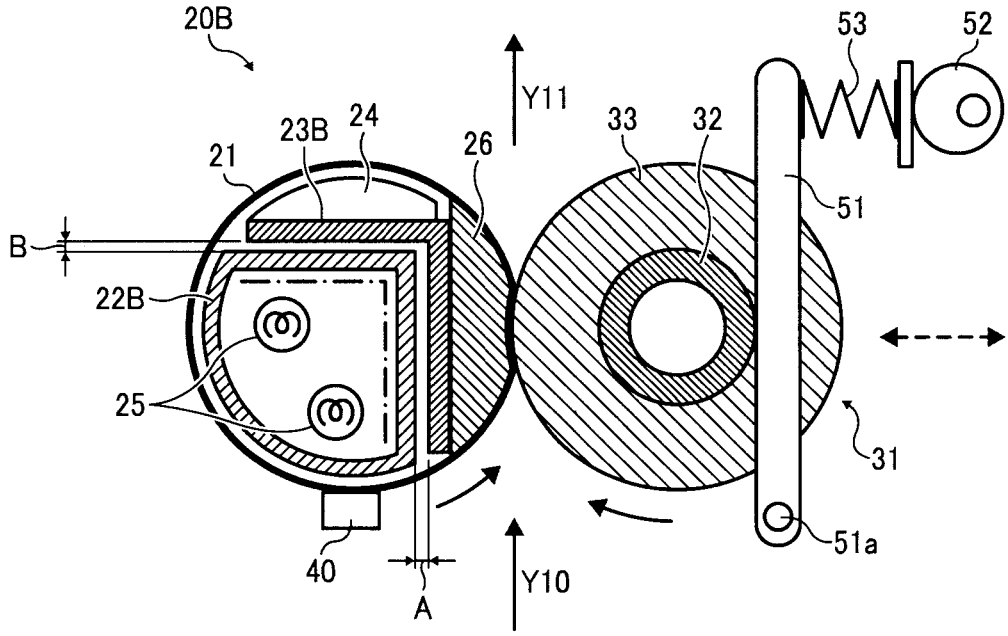
FIG. 8 is an end-on, axial cutaway view schematically illustrating a third embodiment of the fixing device according to this patent specification.

FIG. 8 is an end-on, axial cutaway view schematically illustrating a third embodiment 20B of the fixing device according to this patent specification, which differs from the first embodiment 20 primarily in that it employs a heat pipe 22B with two flattened sides in combination with a reinforcing member 23B for the fuser pad 26.

As shown in FIG. 8, the overall configuration of the fixing device 20B is similar to that depicted primarily with reference to FIG. 2, including the fuser pad 26 pressed against the pressure roller 31 via the fuser belt 21 to form the fixing nip N, the heat pipe 22B equipped with the heaters 25 operated according to readings of the thermometer 40, and the roller biasing mechanism formed of the pressure lever 51, the motor-driven eccentric cam 52, and the spring 53 for adjusting pressure at the fixing nip N, wherein the closed tubular heat pipe 22B has its closed tubular body facing the inner surface of the fuser belt 21 for heating the belt 21.

Specifically, unlike the first embodiment, the heat pipe 22B comprises a tubular body partially square, partially circular in axial cross-section defined by two flattened sides, one extending in a first, load direction in which the pressure roller 31 exerts pressure against the fuser pad 26, and the other in a second, non-load direction substantially perpendicular to the first direction, to form a square corner therebetween, and another, curved side disposed between the flattened sides opposite the square corner, within which the heating assembly 25 is accommodated.

For obtaining high efficiency in heating the fuser belt 21 with the heat pipe 22B, the heat pipe 22B has its inner circumference partly coated with a light reflective material where it does not face the fuser belt 21 outside (as indicated by broken lines in FIG. 8), and partly coated with a heat-resistant, black absorptive material where it faces the fuser belt 21 outside.

With further reference to FIG. 8, adjacent to the heat pipe 22B is the reinforcing member 23B provided to reinforce the fuser pad 26. The reinforcing member 23B comprises an elongated beam with an L-shaped axial cross-section, having a length substantially equal to that of the fuser pad 26. The reinforcing member 23B is disposed stationary inside of the loop of the fuser belt 21 and outside of the hollow heat pipe 22B, or more precisely, along the flattened sides of the heat pipe 22B, with its two longitudinal ends secured to the sidewalls of the fixing device 20B.

When viewed in cross-section, the reinforcing member 23B has a pair of adjacent flat sides extending perpendicular to each other, one facing against the fuser pad 26 in the load direction and the other flat side facing the non-load direction. The reinforcing member 23B thus supports pressure applied from the pressure roller 31 via the fuser pad 26 and the fuser belt 21, thereby preventing the fuser pad 26 against deformation and displacement under nip pressure. For obtaining sufficient reinforcing performance, the reinforcing member 23B is formed of relatively rigid material, such as stainless steel, iron, or the like.

The heat pipe 22B has its two flattened sides each extending along the respective flat sides of the reinforcing member 23B with appropriate spacing provided between their adjacent surfaces. That is, between the heat pipe 22B and the reinforcing member 23B, there are provided a relatively large gap A where their adjacent surfaces extend parallel to each other along the non-load direction, and a pair of relatively narrow gaps B1 and B2 where their adjacent surfaces extend parallel to each other along the load direction.

Provision of the gaps A, B1, and B2 prevents the metal pipe 22B from contacting or pressing against the reinforcing member 23B. As is the case with the embodiments described earlier, such spacing isolates the heat pipe 22B from nip pressure transmitted through the fuser pad 26 and the reinforcing member 23B from the pressure roller 31, which ensures high immunity of the heat pipe 22B against deformation.

For effectively isolating the heat pipe 22B from nip pressure, the first gap A extending in the load direction is sufficiently large, so as to keep the heat pipe 22B out of pressure contact with the reinforcing member 23B, which tends to bend away from the fixing nip N in the load direction during operation. By contrast, the second gap B extending in the non-load direction is relatively small so as to maintain proper spacing in the second direction for thermal insulation from the heat pipe 22B to the reinforcing member 23B.

Similar to the embodiments described earlier, in the fixing device 20B, the gaps A and B defined between the adjacent surfaces of the heat pipe 22*b* and the reinforcing member 23B serve to retain lubricant for future supply to the inner surface of the fuser belt 21. That is, the lubricant is held in position by surface tension within the narrow gaps A and B, of which a certain amount flows gradually and continually toward the inner surface of the fuser belt 21 as the lubricant originally applied to the belt surface wears off with time. Such gradual, continual supply of lubricant effectively prevents premature loss of lubrication of the fuser belt 21 so that the fuser belt 21 can rotate without excessive friction for an extended period of time during operation of the fixing device 20B.

With still further reference to FIG. 8, the reinforcing member 23*b* is shown provided with a belt guide 24 on the side extending in the non-load direction. The belt guide 24 serves to guide the fuser belt 21 rotating around the heat pipe 22B in its generally cylindrical configuration.

Figure 9:
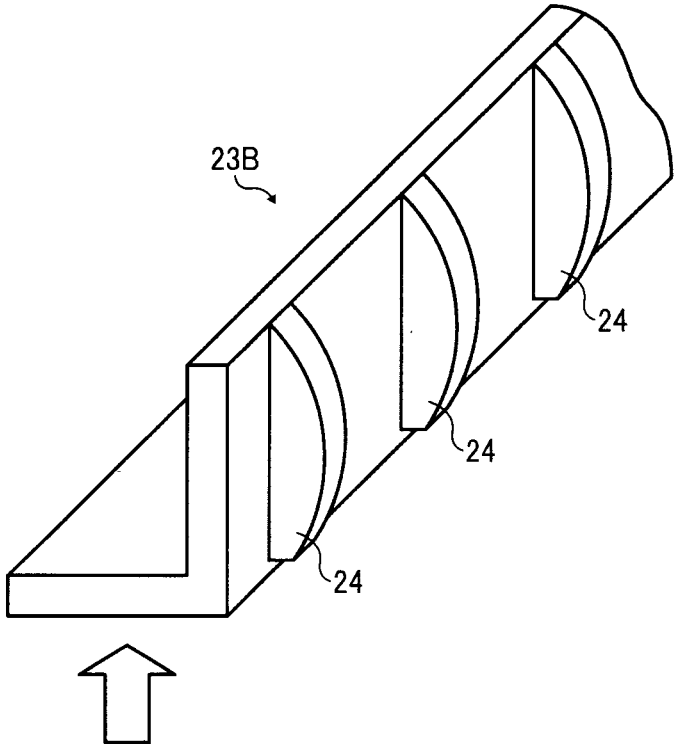
FIG. 9 is a perspective view illustrating a reinforcing member employed in the fixing device of FIG. 8.

Specifically, as shown in FIG. 9, which is a perspective view schematically illustrating the reinforcing member 23 equipped with the belt guide 24, the belt guide 24 comprises multiple ribs arranged at intervals along the axial direction, each formed of heat-resistant material with a smooth frictionless surface, such as polyphenylene sulfide (PPS), shaped in the form of circular segment, and projecting outward from the surface of the reinforcing member 23*b* with its curved edge facing the inner surface of the fuser belt 21.

Note that the heat pipe 22B, the fuser pad 26, and the guide ribs 24 all include curved surfaces which, when assembled, together define a closed curved surface with a circumference thereof smaller than the inner circumference of the fuser belt 21. During rotation, the flexible fuser belt 21 moves along the outer surfaces of those curved structures 22B, 24, and 26 so as to maintain its generally cylindrical configuration, thereby remaining free from substantial deformation which would otherwise result in damage and concomitant failures.

Additionally, the guide ribs 24 define multiple relatively small guide surfaces arranged along the axial direction, each of which can occasionally establish contact with the inner surface of the fuser belt 21 being guided. Compared to a belt guide that defines a single continuous surface extending in the axial direction, the use of the multiple guide ribs 24 is efficient in terms of the amount of heat dissipated by flowing to the reinforcing member as the belt contacts the belt guide.

Hence, the fixing device 20B according to this patent specification can operate with extremely short warm-up time and first-print time without failures caused by insufficient heating in high speed application, wherein the closed tubular configuration of the thermal pipe 22B, with its tubular body facing the inner surface of the fuser belt 21 for heating and spaced away from the reinforcing member 23B for isolation from nip pressure, provides protection against entry of lubricant and other foreign matter into the heat pipe, against premature loss of lubrication of the fuser belt, and against deformation of the heat pipe under nip pressure even where the heat pipe is of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

Figure 10:
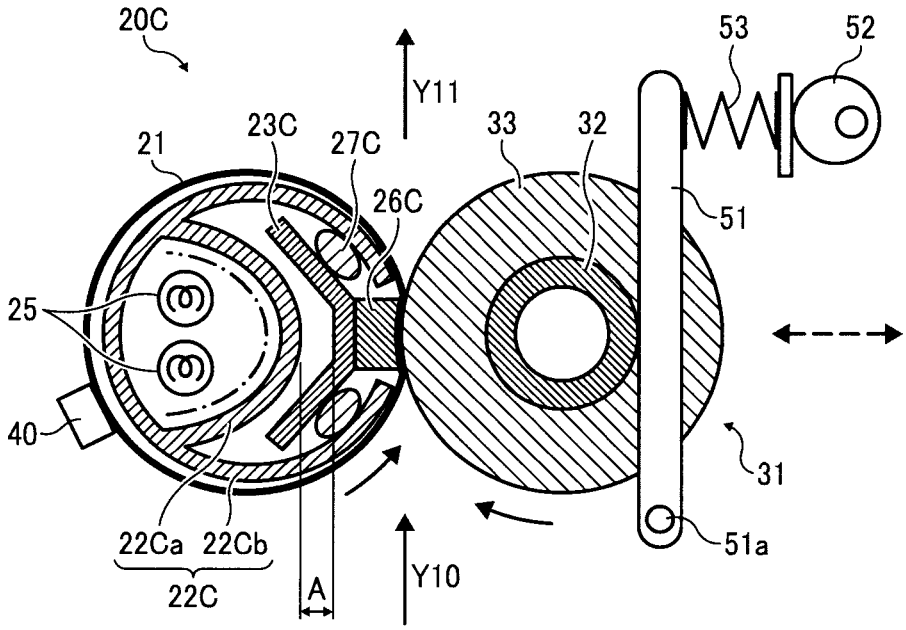
FIG. 10 is an end-on, axial cutaway view schematically illustrating a fourth embodiment of the fixing device according to this patent specification.

FIG. 10 is an end-on, axial cutaway view schematically illustrating a fourth embodiment 20C of the fixing device according to this patent specification, which differs from the first embodiment 20 primarily in that it employs a heat pipe 22C with a composite cross-section and a generally rectangular fuser pad 26C in combination with a reinforcing member 23C for reinforcing the fuser pad 26C.

As shown in FIG. 10, the overall configuration of the fixing device 20C is similar to that depicted primarily with reference to FIG. 2, including the fuser pad 26C pressed against the pressure roller 31 via the fuser belt 21 to form the fixing nip N, the heat pipe 22C equipped with the heaters 25 operated according to readings of the thermometer 40, and the roller biasing mechanism formed of the pressure lever 51, the motor-driven eccentric cam 52, and the spring 53 for adjusting pressure at the fixing nip N, wherein the tubular heat pipe 22C has its partially closed tubular body facing the inner surface of the fuser belt 21 for heating the belt 21 except where the belt surface faces the fuser pad 26A.

Specifically, unlike the first embodiment, the heat pipe 22C comprises a generally cylindrical body consisting of a first, tubular portion 22Ca and a pair of second, opposed curved portions 22Cb extending from the first portion 22Ca, integrally formed or otherwise integrated into a single composite structure. The tubular portion 22Ca defines a compartment closed in axial cross-section on one side of the cylindrical body within which the heating assembly 25 is accommodated, and the second portions 22Cb together define a slot or opening on the other side of the cylindrical body in which the fuser pad 26C is inserted. The first and second portions 22Ca and 22Cb have their curved surfaces forming a generally cylindrical circumference along which the belt 21 can move while maintaining its generally cylindrical circumference during rotation.

In such a configuration, to warm up the fuser belt 21, the heaters 25 directly heat the wall of the tubular portion 22Ca by radiation, which immediately conducts heat to the walls of the curved portions 22Cb, thereby heating the entire circumference of the heat pipe 22C. Thus, the heat pipe 22C heats the inner surface of the fuser belt 21 by conduction except where the belt surface faces the fuser pad 26 inserted in the side slot of the heat pipe 22C.

For obtaining high efficiency in heating the fuser belt 21 with the heat pipe 22C, the first portion 22Ca has its inner circumference partly coated with a light reflective material where it does not face the fuser belt 21 outside (as indicated by broken lines in FIG. 10), and partly coated with a heat-resistant, black absorptive material where it faces the fuser belt 21 outside.

Further, for ensuring high accuracy and responsiveness of the thermometer 40 detecting the operating temperature of the fuser belt 21, the thermometer 40 is positioned facing the outwardly curved surface of the first portion 22Ca via the thickness of the fuser belt 21.

With further reference to FIG. 10, adjacent to the heat pipe 22C is the reinforcing member 23C for reinforcing the fuser pad 26C. As shown in FIG. 10, the reinforcing member 23C comprises an elongated beam with a generally rectangular U-shaped axial cross-section, having a length substantially equal to that of the fuser pad 26. The reinforcing member 23C is disposed stationary inside of the loop of the fuser belt 21 and outside of the tubular portion 22Ca of the heat pipe 22C, or more precisely, inserted between the walls of the first and second portions 22Ca and 22Cb of the heat pipe 22C, with its two longitudinal ends secured to the sidewalls of the fixing device 20C.

When viewed in cross-section, the reinforcing member 23C has a flat side facing against the fuser pad 26C in the load direction, from the opposite ends of which a pair of flat sides extends without touching the neighboring walls of the first and second portions 22Ca and 22Cb of the heat pipe 22C. The reinforcing member 23C thus supports pressure applied from the pressure roller 31 via the fuser pad 26C and the fuser belt 21, thereby preventing the fuser pad 26C against deformation and displacement under nip pressure. For obtaining sufficient reinforcing performance, the reinforcing member 23C is formed of relatively rigid material, such as stainless steel, iron, or the like.

The first and second portions 22Ca and 22Cb of the heat pipe 22C have their respective walls extending along the wall of the reinforcing member 23C with sufficient spacing provided there between. In particular, a relatively large gap A is provided between an adjoining surface of the heat pipe 22C and an adjoining surface of the reinforcing member 23C which extend substantially parallel to each other along the second direction. As is the case with the embodiments described earlier, such spacing isolates the heat pipe 22C from nip pressure transmitted through the fuser pad 26C and the reinforcing member 23C from the pressure roller 31, which ensures high immunity of the heat pipe 22C against deformation.

Compared to the configuration with a substantially L-shaped cross-section, the reinforcing member 23C with a substantially U-shaped cross-section occupies a relatively large space inside the loop of the fuser belt 21. Thus, the reinforcing member 23C is more suitable for use with the heat pipe 22C of the composite structure than with the heat pipe 22B with the partially squared cross-section, since providing a belt guide in addition to the reinforcing member 23C inside the belt loop would reduce the extent to which the curved surface of the heat pipe 22C faces the fuser belt 21, which results in a reduced efficiency in heating the fuser belt 21 by conduction from the heat pipe 22C.

With still further reference to FIG. 10, there is shown a pair of lubricant retaining members 27C disposed outside the closed tubular portion 22Ca of the heat pipe 22C and out of sliding contact with the inner surface of the fuser belt 21 to retain lubricant on the pipe surface for future supply to the inner surface of the fuser belt 21. The lubricant retaining member 27 comprises a heat-resistant elastic sponge impregnated with lubricant, positioned between the inner surfaces of the heat pipe 22C and outer surfaces of the reinforcing member 23C to close the side opening defined by the second portion 22Cb of the heat pipe 22C.

Unlike the embodiments described earlier, in the fixing device 20C, the gap defined between the adjoining surfaces of the heat pipe 22C and the reinforcing member 23C is not uniform and relatively large, and therefore cannot serve to retain lubricant for future supply to the inner surface of the fuser belt 21. Rather, there would be a risk of losing proper lubrication in which the lubricant originally provided to the inner surface of the fuser belt migrates into the relatively large gap through the open side of the heat pipe 22C, if no remedy were provided.

The lubricant retaining member 27C retains lubricant between the inner surfaces of the heat pipe 22C and outer surfaces of the reinforcing member 23C, while preventing migration of lubricant from outside the heat pipe 22C, and releases a certain amount of lubricant gradually and continually toward the inner surface of the fuser belt 21 as the lubricant originally applied to the belt surface wears off with time. Such gradual, continual supply of lubricant effectively prevents premature loss of lubrication of the fuser belt 21 so that the fuser belt 21 can rotate without excessive friction for an extended period of time during operation of the fixing device 20C.

Although interposed between the inner surfaces of the heat pipe 22C and the outer surfaces of the reinforcing member 23C, the lubricant retaining member 27C formed of elastic material does not transmit mechanical stress from the reinforcing member 23C to the heat pipe 22C. Hence, provision of the lubricant retaining member 27C does not affect isolation of the heat pipe 22C from nip pressure, which secures high immunity of the heat pipe 22C against deformation even where the reinforcing member 23C and/or the fuser pad 26C deforms under nip pressure.

Hence, the fixing device 20C according to this patent specification can operate with extremely short warm-up time and first-print time without failures caused by insufficient heating in high speed application, wherein the closed tubular configuration of the thermal pipe 22C, with its partially tubular body facing the inner surface of the fuser belt 21 for heating and spaced away from the reinforcing member 23C for isolation from nip pressure, provides protection against entry of lubricant and other foreign matter into the heat pipe, against premature loss of lubrication of the fuser belt, and against deformation of the heat pipe under nip pressure even where the heat pipe is of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

Figure 11:
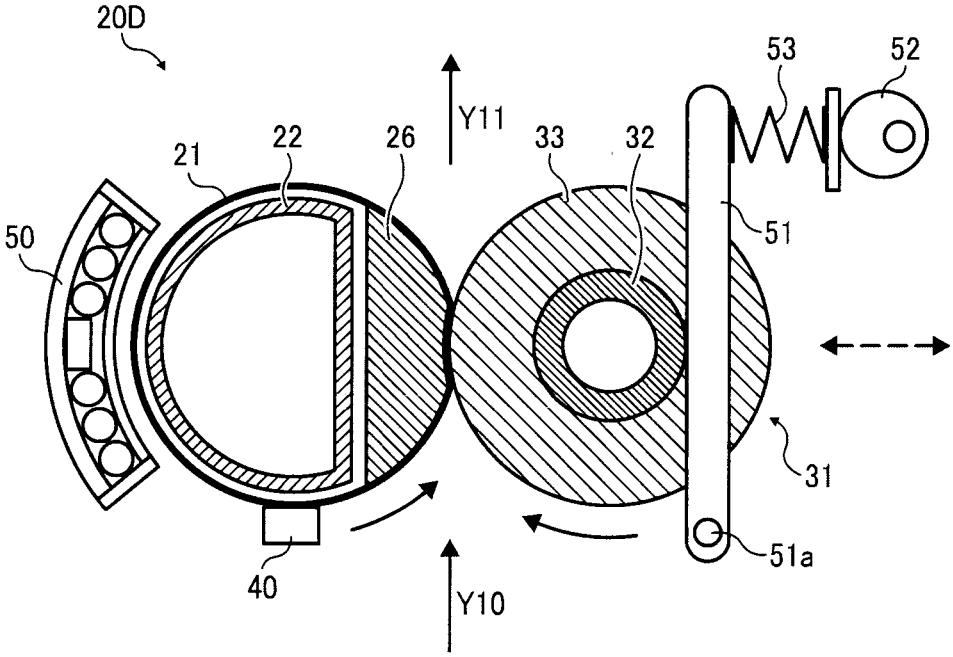
FIG. 11 is an end-on, axial cutaway view schematically illustrating a fifth embodiment of the fixing device according to this patent specification.

FIG. 11 is an end-on, axial cutaway view schematically illustrating a fifth embodiment 20D of the fixing device according to this patent specification, which differs from the first embodiment 20 primarily in that it employs an induction heater 50 that heats the roller circumference from outside the roller interior by electromagnetic induction, in place of the radiant heaters 25 disposed within the roller interior to heat the roller circumference through radiation.

As shown in FIG. 11, the overall configuration of the fixing device 20D is similar to that depicted primarily with reference to FIG. 2, including the fuser pad 26 pressed against the pressure roller 31 via the fuser belt 21 to form the fixing nip N, the heat pipe 22 equipped with the heater 50 operated according to readings of the thermometer 40, and the roller positioning mechanism formed of the pivotable pressure lever 51, the motor-driven eccentric cam 52, and the spring 53 for adjusting pressure at the fixing nip N, wherein the closed tubular heat pipe 22 has its closed tubular body facing the inner surface of the fuser belt 21 for heating the belt 21 except where the belt surface faces the fuser pad 26.

Specifically, the induction heater 50 consists of a set of electromagnetic coils or Litz wires each being a bundle of thinner wires extending across a portion of the fuser belt 21 in the axial direction and opposed to a semi-cylindrical main core formed of a ferromagnetic material with a high magnetic permeability ranging from approximately 1,000 to approximately 3,000, and optionally equipped with auxiliary central and/or side cores for efficient formation of magnetic flux, all of which are held by a coil support of suitable material such as heat resistant resin or the like.

During operation, the induction heater 50 generates an alternating magnetic field around the heat pipe 22 as a highfrequency alternating current passes through the electromagnetic coils. The changing magnetic field induces eddy currents over the circumference of the heat pipe 22, which exhibits certain electrical resistivity to produce a corresponding amount of Joule heat from within.

The heat pipe 22 thus heated through electromagnetic induction releases heat to the length of the fuser belt 21 rotating in the proximity of the roller circumference, resulting in heating the fixing nip N to a desired processing temperature.

For maximizing heating efficiency through electromagnetic induction, preferably, the heat pipe 22 is made of any suitable metal, including, but not limited to, nickel, stainless steel, iron, copper, cobalt, chromium, aluminum, gold, platinum, silver, tin, palladium, and alloys containing one or more of these metals.

Figure 12:
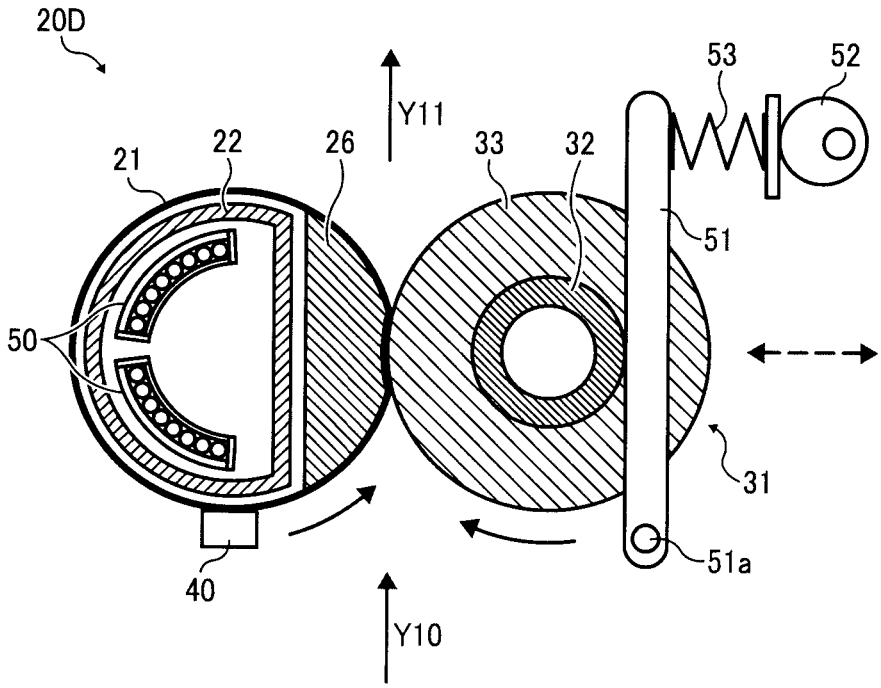
FIG. 12 is an end-on, axial cutaway view illustrating an arrangement of the fifth embodiment.

In the embodiment depicted in FIG. 11, the fixing device 20D has the induction heater 50 disposed outside the heat pipe 22. Instead, it is also possible to dispose the induction heater 50 within the closed interior of the heat pipe 22, as shown in FIG. 12. Positioning within the closed pipe interior protected against entry of lubricant prevents the induction heater 50 from contamination with lubricant, thereby ensuring proper operation of the induction heater 50.

Hence, the fixing device 20D according to this patent specification can operate with extremely short warm-up time and first-print time without failures caused by insufficient heating in high speed application, wherein the closed tubular configuration of the thermal pipe 22, with its tubular body facing the inner surface of the fuser belt 21 for heating and spaced away from the fuser pad 26 for isolation from nip pressure, provides protection against entry of lubricant and other foreign matter into the heat pipe, against premature loss of lubrication of the fuser belt, and against deformation of the heat pipe under nip pressure even where the heat pipe is of an extremely thin wall of material, or where the pressure roller presses against the fuser pad at higher nip pressures, or where the pressure roller repeatedly strikes against the fuser pad as it is positioned with respect to the fuser belt to adjust the length and pressure of the fixing nip.

Although the embodiments depicted above uses a radiant heater or an induction heater, in further embodiment, heating the heat pipe 22 may be accomplished using a resistance heater attached to part or entire area of the inner circumference of the heat pipe 22, instead of radiant heating or induction heating. Such resistance heater may include a substrate of electrically resistive heating element, such as a ceramic heater, disposed within the hollow interior of the heat pipe 22 with its opposed ends connected to a power supply.

During operation, the resistance heater is supplied with a current from the power supply to generate an amount of heat proportional to the electrical resistance of the heating element for conduction to the inner circumference of the heat pipe 22. The heat pipe 22 thus heated through resistance heating releases heat to the length of the fuser belt 21 rotating in the proximity of the roller circumference, resulting in heating the fixing nip N to a desired processing temperature.

Alternatively, instead of providing a resistance heater separate from the heat roller, it is also possible to generate heat by employing the heat pipe 22 as a resistance heater, in which case the heat pipe 22 is configured into a thin-walled roller of electrically resistive heating material with two ends connected to a power supply from which a supply of current flows across the heating element to generate heat for releasing to the length of the fuser belt 21.

Thus, the fixing device according to this patent specification may be configured with various types of fuser assemblies and various types of heating mechanism. In any such configuration, the fixing device provides reliable, high-speed imaging performance with high immunity to entry of foreign matter into the heat pipe, to premature loss of lubrication, and to deformation of the heat pipe under nip pressure.

Further, although the embodiments described above employ a pressure roller, the fixing device according to this patent specification may be configured with any suitable type of rotatable body to press against a fuser pad to form a fixing nip. Furthermore, although the embodiments described above employ a multi-layered fuser belt formed of a substrate combined with elastic and releasing layers, the fixing device according to this patent specification may be configured with any suitable type of endless belt or film, formed of any one or combination of polyimide, polyamide, fluorine resin, and metal, looped for rotation around the heat pipe while heated. In any such configuration, the fixing device provides reliable, high-speed imaging performance with high immunity to entry of foreign matter into the heat pipe, to premature loss of lubrication, and to deformation of the heat pipe under nip pressure.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a thermal member that is stationary and at least partially tubular, the thermal member having a tubular portion extending in an axial direction and defining a closed axial cross-section, and a circumference of the thermal member is subjected to heating;

a flexible fuser belt looped for rotation around the thermal member, an inner circumference of the flexible fuser belt at least partially facing the thermal member to transfer heat from the circumference of the thermal member;

a fuser pad held stationary inside the loop of the flexible fuser belt; and a rotatable pressure member extending opposite the thermal member in the axial direction with the flexible fuser belt interposed between the fuser pad and the rotatable pressure member, wherein the fuser pad is pressed against the rotatable pressure member through the flexible fuser belt to form a fixing nip through which a recording medium is passed to fix a toner image on the recording medium under heat and pressure, wherein the thermal member is spaced apart from the fuser pad, so as to isolate the thermal member from pressure transmitted through the fuser pad from the rotatable pressure member, and wherein a first gap between adjacent surfaces of the thermal member and the fuser pad is substantially the same as a second gap between adjacent surfaces of the thermal member and the flexible fuser belt.

2. The fixing device according to claim 1, further comprising a reinforcing member disposed stationary inside the loop of the flexible fuser belt and outside the tubular portion of the thermal member to reinforce the fuser pad, wherein the thermal member is spaced apart from the reinforcing member, so as to isolate the thermal member from pressure transmitted through the reinforcing member from the rotatable pressure member.

3. The fixing device according to claim 1, wherein the thermal member and the fuser pad together define a closed curved surface with a circumference smaller than the inner circumference of the flexible fuser belt, and the flexible fuser belt moves along the closed curved surface during rotation around the thermal member.

4. The fixing device according to claim 1, further comprising a heater accommodated within the tubular portion of the thermal member to heat the circumference of the thermal member.

5. The fixing device according to claim 4, wherein the heater comprises a radiant heater that radiates light for heating, and wherein an interior of the tubular portion of the thermal member is coated with reflective material where the inner circumference of the flexible fuser belt does not face the thermal member outside.

6. The fixing device according to claim 4, wherein the heater comprises a directional radiant heater that radiates light in a particular direction for heating, and is positioned to internally irradiate the tubular portion of the thermal member where the inner circumference of the flexible fuser belt faces the thermal member outside.

7. The fixing device according to claim 1, wherein lubricant is provided between the flexible fuser belt and the thermal member.

8. The fixing device according to claim 7, further comprising means for retaining lubricant for supply between the flexible fuser belt and the thermal member.

9. The fixing device according to claim 8, wherein the lubricant retaining means includes the first gap defined between the thermal member and the fuser pad, and lubricant temporarily remains in position in the first gap by surface tension before flowing to the inner circumference of the fuser belt.

10. The fixing device according to claim 1, wherein the thermal member and the fuser pad are spaced approximately 1 millimeter apart.

11. A fixing device comprising:

a thermal member that is stationary and at least partially tubular, the thermal member having a tubular portion extending in an axial direction and defining a closed axial cross-section, and a circumference of the thermal member is subjected to heating;

a flexible fuser belt looped for rotation around the thermal member, an inner circumference of the flexible fuser belt at least partially facing the thermal member to transfer heat from the circumference of the thermal member;

a fuser pad held stationary inside the loop of the flexible fuser belt;

a rotatable pressure member extending opposite the thermal member in the axial direction with the flexible fuser belt interposed between the fuser pad and the rotatable pressure member; and lubricant retaining means including an elastic sponge that retains lubricant for supply between the flexible fuser belt and the thermal member, the elastic sponge being disposed outside the tubular portion of the thermal member and out of sliding contact with the inner circumference of the flexible fuser belt, which is impregnated with lubricant to be released to the inner circumference of the flexible fuser belt, wherein the fuser pad is pressed against the rotatable pressure member through the flexible fuser belt to form a fixing nip through which a recording medium is passed to fix a toner image on the recording medium under heat and pressure, and wherein the thermal member is spaced apart from the fuser pad, so as to isolate the thermal member from pressure transmitted through the fuser pad from the rotatable pressure member.

12. A fixing device comprising:

a thermal member that is stationary and at least partially tubular, the thermal member having a tubular portion thereof extending in an axial direction and defining a closed axial cross-section, and a circumference of the thermal member is subjected to heating;

a flexible fuser belt looped for rotation around the thermal member, an inner circumference of the flexible fuser at least partially facing the thermal member to transfer heat from the circumference of the thermal member;

a fuser pad held stationary inside the loop of the flexible fuser belt; and a rotatable pressure member extending opposite the thermal member in the axial direction with the flexible fuser belt interposed between the fuser pad and the rotatable pressure member, wherein the fuser pad is pressed against the rotatable pressure member through the flexible fuser belt to form a fixing nip through which a recording medium is passed to fix a toner image on the recording medium under heat and pressure, wherein the thermal member is spaced apart from the fuser pad, so as to isolate the thermal member from pressure transmitted through the fuser pad from the rotatable pressure member, and wherein the thermal member comprises a pipe formed of metal with a thickness of approximately 0.2 millimeters or less.

13. An image forming apparatus comprising:

an electrophotographic imaging unit to form a toner image on a recording medium; and a fixing device to fix the toner image in place on the recording medium, the fixing device including:

a thermal member that is stationary and at least partially tubular, the thermal member having a tubular portion extending in an axial direction and defining a closed axial cross-section, and a circumference of the thermal member is subjected to heating;

a flexible fuser belt looped for rotation around the thermal member, an inner circumference of the flexible fuser belt at least partially facing the thermal member to transfer heat from the circumference of the thermal member;

a fuser pad held stationary inside the loop of the flexible fuser belt; and a rotatable pressure member extending opposite the thermal member in the axial direction with the flexible fuser belt interposed between the fuser pad and the rotatable pressure member, wherein the fuser pad is pressed against the rotatable pressure member through the flexible fuser belt to form a fixing nip through which the recording medium is passed to fix the toner image on the recording medium under heat and pressure, wherein the thermal member is spaced apart from the fuser pad, so as to isolate the thermal member from pressure transmitted through the fuser pad from the rotatable pressure member, and wherein a first gap between adjacent surfaces of the thermal member and the fuser pad is substantially the same as a second gap between adjacent surfaces of the thermal member and the flexible fuser belt.

* * * * *